US009149081B2

(12) United States Patent
Wilson, II

(10) Patent No.: US 9,149,081 B2
(45) Date of Patent: Oct. 6, 2015

(54) GARMENT WAIST ASSEMBLY

(71) Applicant: Hylete LLC, Solana Beach, CA (US)

(72) Inventor: Ronald L. Wilson, II, Solana Beach, CA (US)

(73) Assignee: Hylete, LLC, Solana Beach, CA (US)

( * ) Notice: Subject to any disclaimer, the term of this patent is extended or adjusted under 35 U.S.C. 154(b) by 297 days.

(21) Appl. No.: 13/946,736

(22) Filed: Jul. 19, 2013

(65) Prior Publication Data

US 2015/0020286 A1 Jan. 22, 2015

(51) Int. Cl.
*A41F 9/00* (2006.01)
*A41F 9/02* (2006.01)

(52) U.S. Cl.
CPC ..... *A41F 9/025* (2013.01); *A41D 2300/33* (2013.01)

(58) Field of Classification Search
CPC ..... A41D 1/00; A41D 1/06; A41D 1/08; A41D 7/00; A41D 7/005; A41D 13/02; A41F 9/025; A41F 1/02; A41F 9/00; A41F 9/02
USPC ..... 2/235, 237, 238, 336; 24/389, 715.3
See application file for complete search history.

(56) References Cited

U.S. PATENT DOCUMENTS

| | | | | |
|---|---|---|---|---|
| 181,155 | A * | 8/1876 | Eager | 2/237 |
| 770,871 | A * | 9/1904 | Slater | 24/267 |
| 898,511 | A * | 9/1908 | Schneider | 2/221 |
| 918,324 | A * | 4/1909 | Hodgate | 2/221 |
| 1,825,271 | A * | 9/1931 | Karberg | 2/237 |
| 2,489,083 | A | 11/1949 | Dubin | |
| 3,098,238 | A | 7/1963 | Diamond | |
| 3,161,890 | A | 12/1964 | Betz | |
| 5,255,392 | A | 10/1993 | Stanislaw | |
| 5,524,800 | A | 6/1996 | Arney | |
| 5,598,586 | A | 2/1997 | Munjone | |
| 5,675,842 | A | 10/1997 | Schaefer | |
| 5,717,999 | A | 2/1998 | Lurry | |
| 5,784,723 | A | 7/1998 | Noble et al. | |
| 6,023,789 | A | 2/2000 | Wilson et al. | |
| 6,138,282 | A | 10/2000 | Follese | |
| 6,199,215 | B1 * | 3/2001 | Biggerstaff | 2/234 |
| 6,665,882 | B1 | 12/2003 | Pedrick | |
| 6,735,785 | B2 | 5/2004 | Takayama | |
| 6,789,270 | B1 | 9/2004 | Pedrick | |
| 6,859,944 | B2 | 3/2005 | Kim | |
| 7,124,448 | B2 | 10/2006 | Davenport | |
| 7,174,574 | B2 * | 2/2007 | Fontes | 2/235 |
| 7,757,308 | B2 | 7/2010 | Oomae | |
| 7,950,070 | B2 | 5/2011 | Beven | |
| 8,074,298 | B2 | 12/2011 | Davenport | |
| 8,122,520 | B2 | 2/2012 | Wilson | |
| 8,429,762 | B2 * | 4/2013 | Weisman | 2/67 |
| 2005/0081275 | A1 | 4/2005 | Galvao | |
| 2005/0177920 | A1 | 8/2005 | Wilkinson | |

(Continued)

*Primary Examiner* — Danny Worrell
(74) *Attorney, Agent, or Firm* — Tsircou Law, P.C.

(57) ABSTRACT

A garment is disclosed having multiple wearing options. The garment includes a waistband that defines inner openings and outer openings in the front of the waistband assembly on opposing sides of the front centerline of the garment providing access to the drawstring channel from the inner side and the outer side of the waist assembly, respectively. The drawstring optionally passes through the pair of inner openings or the outer openings to tie in the front of the garment. In this manner, the waist assembly that provides multiple wearing options, including with the drawstring exposed, with the drawstring hidden, and waistband flipped with drawstring and indicia exposed.

17 Claims, 4 Drawing Sheets

(56) References Cited

U.S. PATENT DOCUMENTS

| | | | |
|---|---|---|---|
| 2005/0261113 | A1 | 11/2005 | Wilkinson |
| 2008/0172769 | A1 | 7/2008 | Herget |
| 2009/0320182 | A1 | 12/2009 | Schmalz et al. |
| 2011/0131708 | A1 | 6/2011 | Miller |
| 2012/0011638 | A1 | 1/2012 | Geary |
| 2012/0267017 | A1 | 10/2012 | Sloan |
| 2012/0323204 | A1 | 12/2012 | Poole et al. |
| 2013/0007947 | A1 | 1/2013 | Moore et al. |

* cited by examiner

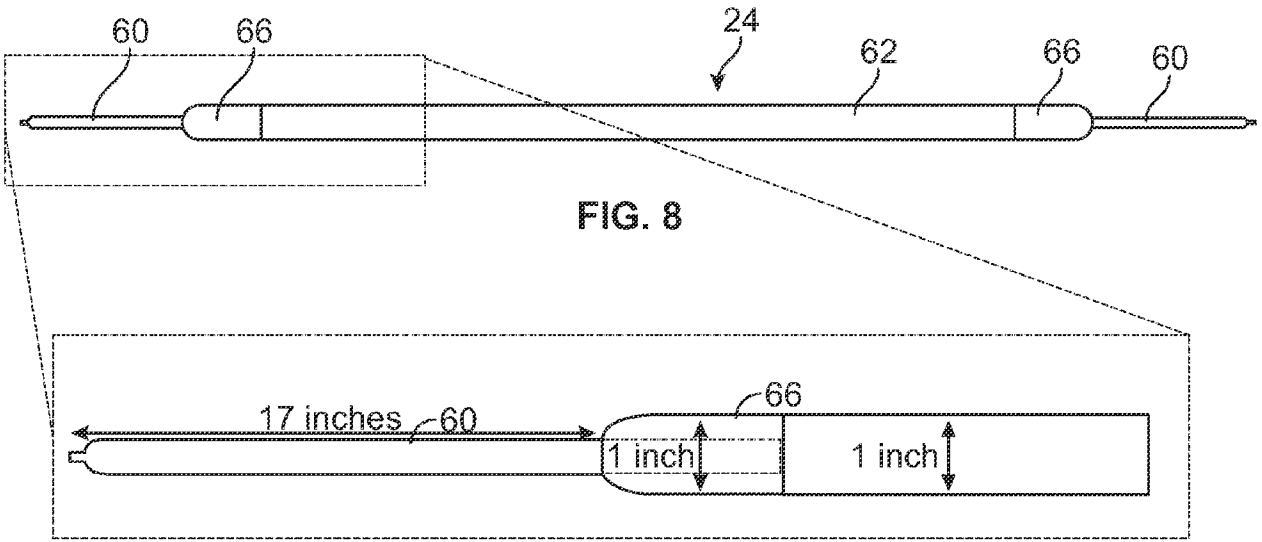
FIG. 8
FIG. 9
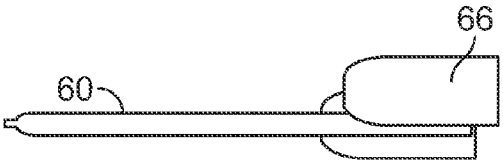
FIG. 10A
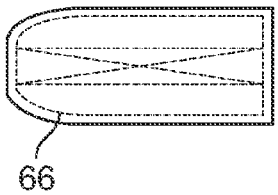
FIG. 10B

GARMENT WAIST ASSEMBLY

FIELD OF THE INVENTION

The present invention relates generally to garments for the lower body and, more particularly, such garments having a waistband assembly convertible for multiple wearing options.

BACKGROUND OF THE INVENTION

The fit of a garment around the waist of the wearer is an important design consideration. This is particularly true for garments used in sports. A proper fit can contribute to an athlete's performance, whereas an improper fit can hamper performance. Moreover, it is a growing trend to wear garments in unique, non-traditional ways as a means for individual expression, such as positioning a garment's waistband comparatively low on the body.

Current approaches for a secure waist fit provide a single configuration for securing the garment around the waist, which can be uncomfortable and limiting individual expression. Thus, the wearer must often time sacrifice a secure waist fit for comfort and better looking fit or sacrifices the comfort and look for a secure waist fit, particularly when the garment is worn in a non-traditional manner.

It should be appreciated that there remains a need for a garment that addresses these concerns. The present invention fulfills this need and others

SUMMARY OF THE INVENTION

Briefly, and in general terms, the invention is embodied in a garment having a waist assembly that provides multiple wearing options. The garment includes a waistband that defines inner openings and outer openings in the front of the waistband assembly on opposing sides of the front centerline of the garment providing access to the drawstring channel from the inner side and the outer side of the waist assembly, respectively. The drawstring optionally passes through the pair of inner openings or the outer openings to tie in the front of the garment. In this manner, the waist assembly that provides multiple wearing options, including with the drawstring exposed, with the drawstring hidden, and waistband flipped with drawstring and indicia exposed. Thus, the garment has several, unique wearing options, allowing the wearer to vary the look and fit of the garment.

More specifically, in an exemplary embodiment, the waistband assembly includes a central panel folded over the front of waistband, confined to the front portion of the garment. The central panel defines both the inner openings and the outer openings.

In a detailed aspect of an exemplary embodiment, the inner openings and the outer openings are aligned with each other to enable the wearer to thread the drawstring ends easily through either pair of opening. The garment includes grommets disposed about the openings.

In another detailed aspect of an exemplary embodiment, the waistband assembly further includes covers attached over the outer openings. The covers have inwardly facing curved edges that provide access to the outer openings, with the remaining edges of the cover attached to the waistband. The covers extend from the upper edge of the waistband to the bottom edge. Both the central panel and the covers are formed of woven material In yet another detailed aspect of an exemplary embodiment, the inner side of the waistband body has indicia spaced along the length thereof. The indicia are oriented such that they are right side-up when the waistband is flipped, exposing the indicia. In the exemplary embodiment, the indicia are logos that spaced along the entire length of the inner side of the waistband. Of course, in other embodiments, the indicia can be confined to particular regions of the waistband. In addition, indicia can be embodied in any graphics, letters, symbols, other representations, or combinations thereof, as desired.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which:

FIG. 8 is plan view of the drawstring assembly of the garment of FIG. 1.

FIG. 9 is a close-up view of Area 9 of the drawstring assembly of FIG. 8.

FIGS. 10A and B are close-up views of the drawstring assembly of FIG. 8

DETAILED DESCRIPTION OF THE PREFERRED EMBODIMENTS

Figure 1:
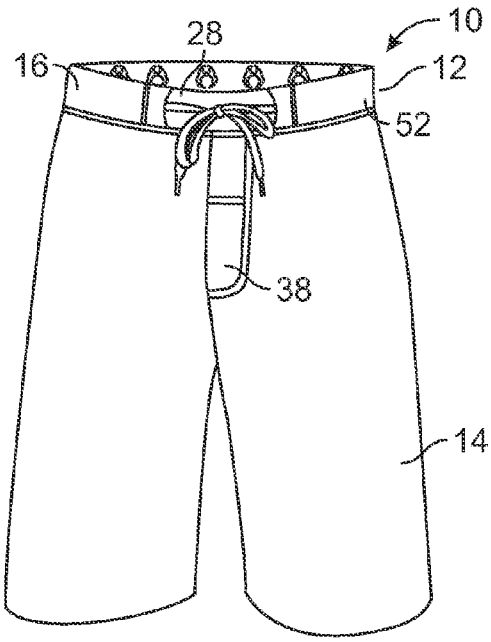
FIG. 1 is a front perspective view of a garment in accordance with the present invention, depicting a drawstring assembly extending through outer openings of the waistband.
Figure 2:
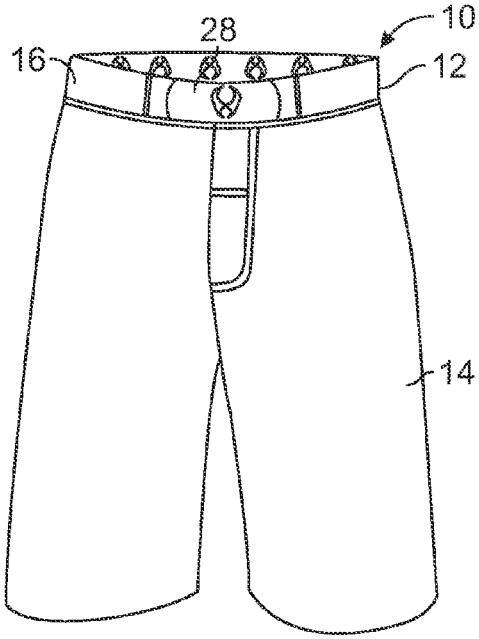
FIG. 2 is a front perspective view of the garment of FIG. 1, depicting the drawstring assembly extending through inner openings of the waistband and hidden.
Figure 3:
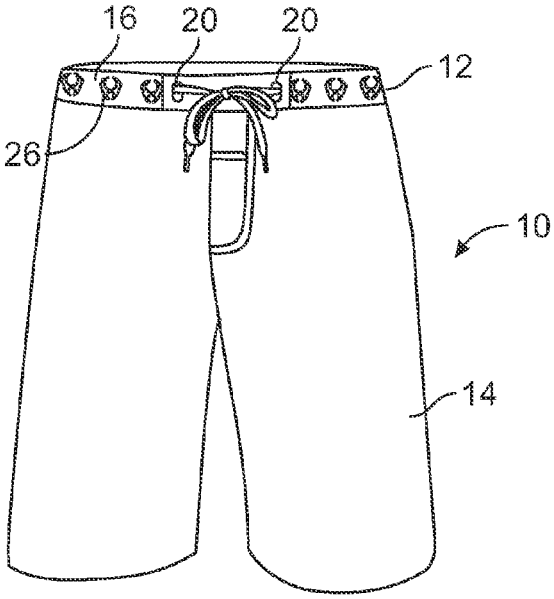
FIG. 3 is a front perspective view of the garment of FIG. 1, depicting the drawstring assembly extending through inner openings of the waistband and the waistband flipped exposing indicia and the drawstring.
Figure 4:
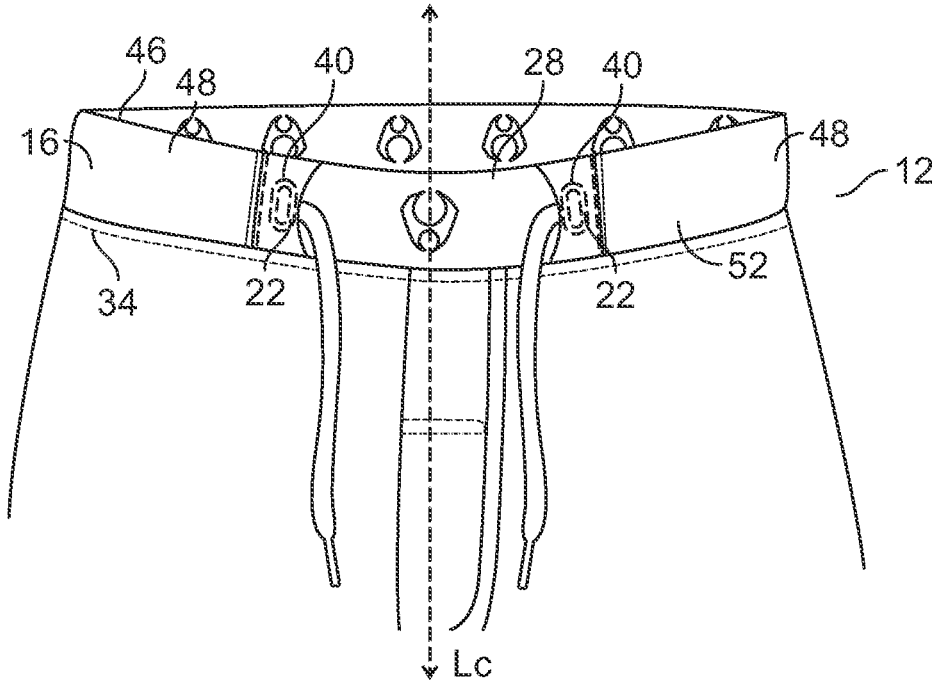
FIG. 4 is close-up front perspective view of the garment of FIG. 1, depicting the front portion of the waistband.

Referring now to the drawings, and particularly FIGS. 1-3, there is shown a garment 10 (athletic shorts) having a waist assembly 12 and a garment body 14. The waist assembly includes a waistband 16 that defines a drawstring channel 18 about the waist. The waist assembly includes inner openings 20 and outer openings 22 in the front of the waistband assembly on opposing sides of the front centerline of the garment providing access to the drawstring channel from the inner side and the outer side of the waist assembly, respectively. The waistband has indicia disposed about an inner side thereof. The waist assembly further includes a drawstring assembly 24 disposed in the drawstring channel 18. The drawstring optionally passes through the pair of inner openings or the outer openings to tie in the front of the garment. In this manner, the waist assembly that provides multiple wearing options, including with the drawstring exposed, with the drawstring hidden, and waistband flipped with drawstring and indicia 26 exposed. Thus, the garment has several, unique wearing options, allowing the wearer to vary the look and fit of the garment.

The waistband assembly 16 includes a central panel 28 folded over the front of waistband, confined to the front portion of the garment. The central panel defines both the inner openings 20 and the outer openings 22. The pairs of openings are disposed on opposing sides of the central panel, bisected by the front centerline (Lc) of the garment. The openings provide access to the drawstring channel 18 to either the interior side or the exterior side of the garment. More particularly, an interior side 30 of the panel extends from a fold line 32 to a bottom edge 34 of the waistband assembly 12 along the interior side of the garment, and an exterior side 36 of the panel 28 extends from the fold line 32 to the bottom edge 34 of the waistband assembly 12 along the exterior side of the garment, above a fly 38 of the garment 10.

The inner openings 20 and the outer openings 22 are aligned with each other to enable the wearer to thread the drawstring ends easily through either pair of openings (20, 22). The garment includes grommets 40 disposed about the openings (20, 22). In the exemplary embodiment, welded rubber grommets are used, though in other embodiments other types of grommets can be used. The central panel 28 is formed of woven fabric material, which facilitates secure attachment and durability of the grommet attachment.

Figure 5:
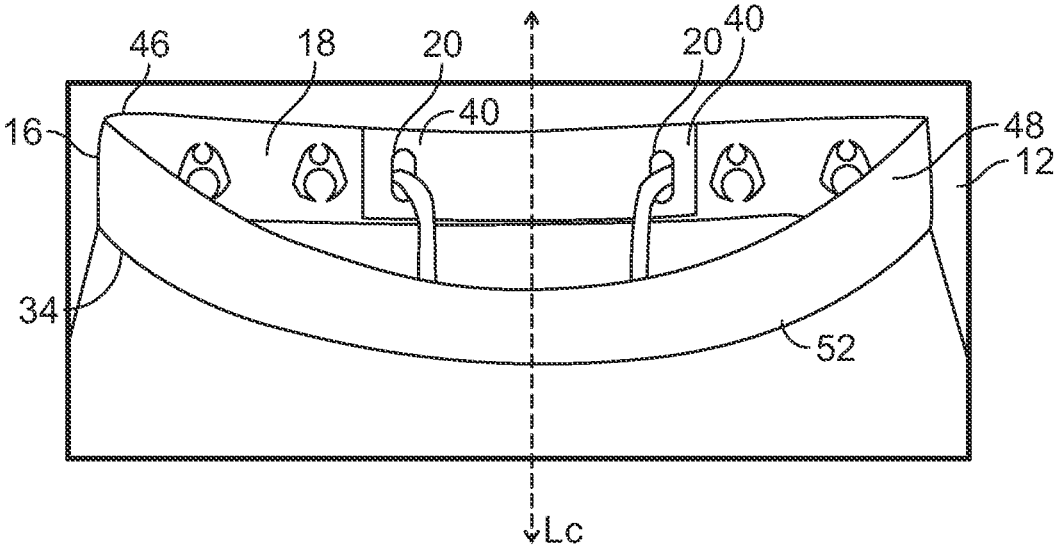
FIG. 5 is close-up rear perspective view of the garment of FIG. 1, depicting in inner side of the waistband.
Figure 6:
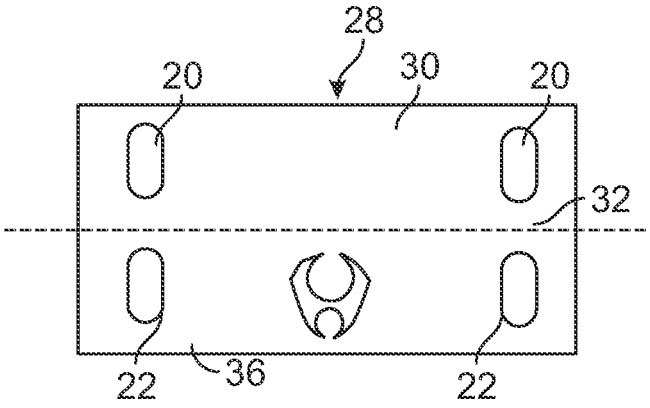
FIG. 6 is a plan view of the cover panel of the garment of FIG. 1.
Figure 7:
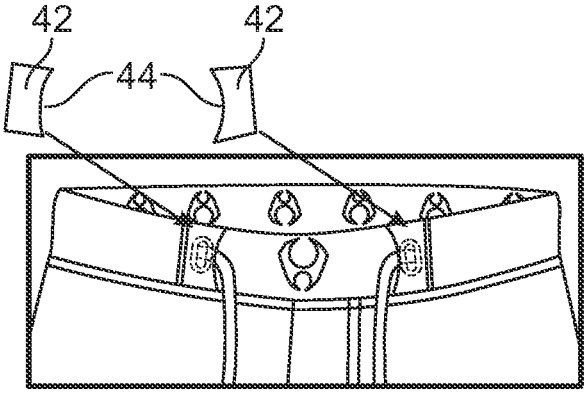
FIG. 7 is partially exploded view of the garment of FIG. 1, depicting covers for the outer openings of the waistband.

The waistband assembly further includes covers 42 attached over the outer openings 22. The covers have inwardly facing curved edges 44 that provide access to the outer openings, with the remaining edges of the cover attached to the waistband. The covers extend from the upper edge 46 of the waistband to the bottom edge 34. Both the central panel and the covers are formed of woven material. The covers 42 provide a clean look the garment, particularly when the user ties the drawstring on the inside of the waist (e.g., FIGS. 2 and 5.), and it also protects the user from inadvertently catching the drawstring on a hand or object.

The drawstring channel 18 is defined by waistband body 48 that is attached to the garment body 14 along the bottom edge 34 thereof via stitching. The waistband body 48 has an outer side 52 is formed of double knit material extending substantially around the waist of the garment, to optimize stretch, comfort and performance. The drawstring channel 18 terminates proximate to the openings (20, 22) on both sides of the front centerline ($L_c$) of the garment 10. Best, this drawstring extend out of the drawstring channel such that it can be threaded through either the inner or the outer openings (20, 22).

The inner side 50 of the waistband body 48 has indicia spaced along the length thereof. The indicia are oriented such that they are right side-up when the waistband is flipped, exposing the indicia (FIG. 3). In this configuration, the drawstring passes through openings 20 and is exposed. In the exemplary embodiment, the indicia are logos that spaced along the entire length of the inner side of the waistband. Of course, in other embodiments, the indicia can be confined to particular regions of the waistband. In addition, indicia can be embodied in any graphics, letters, symbols, other representations, or combinations thereof, as desired. In other embodiments, such indicia can be excluded entirely.

In the exemplary embodiment, the inner side 50 of the waistband body 48 is formed of an elastic jacquard such that the indicia can be provided via a jacquard process. The outer side 52 of the waistband body is formed of double knit material. The elasticity of the inner side and the outer side substantially match. The waistband body is configured such that stretching occurs from a smooth resting position, thereby minimizing bunching of the waistband to provide a smooth appearance. The inner side 50 can also provide moisture retention to keep perspiration draining from the upper body to the shorts.

With reference now to FIGS. 8-10B, the drawstring assembly 24 includes two drawstring ends 60 attached to a central band 62. The central band is formed of non-stretch, durable, thin ribbon material that comfort and durability. In the exemplary embodiment, the central band is formed of satin material having a width of about 1 inch. The central band extends a majority of the circumference of the waist. Drawstring ends 60 are formed of nylon drawstring material having a width of about ½ inch. The drawstring is ends are attached to the central band via stitching. In the exemplary embodiment, each drawstring and overlaps the ribbon by about 2 inches. Two cap pieces 66 of woven material are disposed on opposing sides thereof. The stitching secures the cap pieces, drawstring ends, and the central band together to ensure a durable construction between the drawstring end and the central band. As best seen in FIG. 10B, stitching is applied around the edges and a centered box stitch configuration is applied securing the components together at opposing ends of the central band. In the exemplary embodiment, the drawstring ends are each approximately 19 inches in length, including that overlap of 2 inches such that approximately 17 inches extend beyond the end of the central band 62.

It should be appreciated from the foregoing that the present invention provides a garment having disclosed having multiple wearing options. The garment includes a waistband that defines inner openings and outer openings in the front of the waistband assembly on opposing sides of the front centerline of the garment providing access to the drawstring channel from the inner side and the outer side of the waist assembly, respectively. The drawstring optionally passes through the pair of inner openings or the outer openings to tie in the front of the garment. In this manner, the waist assembly that provides multiple wearing options, including with the drawstring exposed, with the drawstring hidden, and waistband flipped with drawstring and indicia exposed.

The present invention has been described above in terms of presently preferred embodiments so that an understanding of the present invention can be conveyed. However, there are other embodiments not specifically described herein for which the present invention is applicable. Therefore, the present invention should not to be seen as limited to the forms shown, which is to be considered illustrative rather than restrictive.

What is claimed is:

1. A garment having a waist assembly that provides multiple wearing options, comprising:

a waistband assembly defining a drawstring channel that extends around the waist terminating at a front thereof, a pair of inner openings in the front of the waistband on opposing sides of a front centerline of the garment providing access to the drawstring channel, and a pair of outer openings in the front of the waistband assembly on opposing sides of the front centerline of the garment providing access to the drawstring channel; and a drawstring assembly disposed in the drawstring channel having drawstring ends that optionally pass through the pair of inner openings or the outer openings, the drawstring assembly sized to circumscribe the waist to tie in the front.

2. The garment as defined in claim 1, wherein the waistband assembly has indicia disposed on an inner side thereon, the indicia are disposed such that the indicia are right side-up when the waistband is flipped such the inner waistband portion is exposed.

3. The garment as defined in claim 1, further comprising a pair of covers attached over the pair of outer openings.

4. The garment as defined in claim 1, wherein the drawstring assembly includes a central band having first and second ends, a first drawstring attached to the first end, and a second drawstring attached to the second end of the central band, the central band having a greater width than the first and the second drawstrings.

5. The garment as defined in claim 1, wherein the waistband assembly includes a central panel aligned in the front of the waistband and defining the pair of inner openings and the pair of outer openings.

6. The garment as defined in claim 1, further comprising metal grommets disposed about the pair of inner openings and the pair of outer openings.

7. A garment having a waist assembly that provides multiple wearing options, comprising:

a waistband having an inner waistband portion and an outer waistband portion that define a drawstring channel therebetween, the drawstring channel extending about the waist to a front of the garment;

a central panel aligned in the front of the garment disposed over both the inner waistband portion and the outer waistband portion, the central panel defining a pair of inner openings in the front of the waistband on opposing sides of a front centerline of the garment providing access to the drawstring channel, the central panel defining a pair of outer openings in the front of the waistband on opposing sides of a front centerline of the garment providing access to the drawstring channel; and a drawstring assembly disposed in the drawstring channel having two drawstring ends, the drawstring assembly sized the drawstring assembly sized to circumscribe the waist to so that the drawstring ends can tie together through the pair of inner openings or the pair of outer openings.

8. The garment as defined in claim 7, wherein the inner waistband portion having indicia disposed thereon.

9. The garment as defined in claim 8, wherein the indicia are disposed such that the indicia are right side-up when the waistband is flipped such the inner waistband portion is exposed.

10. The garment as defined in claim 7, further comprising a pair of covers attached over the pair of outer openings.

11. The garment as defined in claim 7, wherein the drawstring assembly includes a central band having first and second ends, a first drawstring attached to the first end, and a second drawstring attached to the second end of the central band, the central band having a greater width than the first and the second drawstrings.

12. The garment as defined in claim 7, further comprising a garment body attached below the waistband.

13. The garment as defined in claim 7, wherein the central panel is folded over the waistband having an inner side that defines the pair of inner openings and an outer side that defines the pair of outer openings.

14. The garment as defined in claim 12, wherein the central panel is formed of woven material and the waistband is formed of double knit material.

15. A garment having a waist assembly that provides multiple wearing options, comprising:

a waistband assembly having a waistband having an inner waistband portion and an outer waistband portion that define a drawstring channel therebetween, the drawstring channel extending about the waist to a front of the garment, a central panel aligned in the front of the garment disposed over both the inner waistband portion and the outer waistband portion, the central panel defining a pair of inner openings in the front of the waistband on opposing sides of a front centerline of the garment providing access to the drawstring channel, the central panel defining a pair of outer openings in the front of the waistband on opposing sides of a front centerline of the garment providing access to the drawstring channel, and a pair of covers attached over the pair of outer openings;

a drawstring assembly disposed in the drawstring channel having two drawstring ends, the drawstring assembly sized the drawstring assembly sized to circumscribe the waist to so that the drawstring ends can tie together through the pair of inner openings or the pair of outer openings; and a garment body attached to a lower edge of the waistband assembly such that the waistband assembly can fold over the garment body.

16. The garment as defined in claim 15, wherein the inner waistband portion having indicia disposed thereon.

17. The garment as defined in claim 15, wherein the inner waistband portion is formed of an elastic jacquard and the outer waistband portion is formed of double knit material.

* * * * *